United States Patent [19]

Frehn

[11] 3,967,935

[45] July 6, 1976

[54] CORROSION AND WEAR RESISTANT STEEL SINTER ALLOY

[75] Inventor: Fritz Frehn, Krefeld, Germany

[73] Assignee: Deutsche Edelstahlwerke Gesellschaft mit beschrankter Haftung, Krefeld, Germany

[22] Filed: Sept. 5, 1973

[21] Appl. No.: 394,475

[30] Foreign Application Priority Data

Sept. 11, 1972 Germany ..... 2244470

[52] U.S. Cl. ..... 29/182.7; 29/182.8; 75/126 C; 75/126 P; 75/126 F; 75/126 Q; 75/126 R; 75/126 D; 75/128 W; 75/128 C; 75/128 F; 75/128 G; 75/128 T; 75/128 D; 75/203; 75/204; 148/31

[51] Int. Cl.[2] ..... C22C 29/00

[58] Field of Search ..... 75/126 C, 126 P, 126 F, 75/126 Q, 126 R, 126 D, 128 W, 128 C, 128 F, 128 G, 128 T, 203, 204; 148/31; 29/182.7, 182.8

[56] References Cited

UNITED STATES PATENTS

| | | | |
|---|---|---|---|
| 2,752,666 | 7/1956 | Goetzel et al. | 75/203 |
| 3,183,127 | 5/1965 | Gregory et al. | 148/31 |
| 3,231,709 | 1/1966 | Foley | 75/126 C |
| 3,694,192 | 9/1972 | Brickner et al. | 75/126 C |
| 3,720,504 | 3/1973 | Frehn | 29/182.7 |
| 3,723,077 | 3/1973 | Frehn | 29/182.7 |
| 3,725,016 | 4/1973 | Mal et al. | 29/182.8 |
| 3,771,975 | 11/1973 | Frehn | 29/182.7 |
| 3,778,255 | 12/1973 | Ototani et al. | 75/126 C |
| 3,782,930 | 1/1974 | Shibata | 75/204 |

FOREIGN PATENTS OR APPLICATIONS

| | | | |
|---|---|---|---|
| 1,209,118 | 10/1970 | United Kingdom | 75/126 C |

*Primary Examiner*—Brooks H. Hunt
*Attorney, Agent, or Firm*—Cushman, Darby & Cushman

[57] ABSTRACT

A sinter steel alloy consisting essentially of 20 to 60% of titanium carbide and a completely ferritic steel alloy, matrix of defined composition has good corrosion resistance and enhanced abrasive wear.

4 Claims, No Drawings

CORROSION AND WEAR RESISTANT STEEL SINTER ALLOY

This invention relates to a highly corrosion and wear resistant steel sinter alloy having a high content of metal carbide.

Known powder metallurgically produced alloys contain 10 to 70% by weight of metal carbide, particularly titanium carbide, the balance consisting of a ferritic steel alloy which is hardenable by the decomposition of austenite or the precipitation of intermetallic phases, and which serves as a binder for the metal carbide. Such steel-bound carbide hard alloys have the advantage over metals which are naturally hard, and in which the binder for the metal carbide is iron, nickel or cobalt, that in the soft annealed state they are readily machinable and that the machined parts can then be suitably heat-treated to raise their hardness to a level in the order of Rockwell C70.

Alloyed steels have been proposed as binders for the metal carbide, the binder alloy acting as an austenitic steel matrix for the metal carbide component when it is desired to combine corrosion resistance with wear resistance and hardness.

It is the object of the present invention to provide a steel sinter alloy containing carbide which possesses as high a resistance to corrosion as that possessed by the known alloys based on an austenitic steel matrix, and which in addition have an even better resistance to abrasive wear.

For achieving this object the invention provides a sinter alloy consisting essentially of:

20 to 60% by weight of titanium carbide, and 40 to 80% by weight of a completely ferritic steel alloy containing:

20.5 to 37 % chromium
0.5 to 12 % molybdenum
0. to 1.5 % copper
0 to 4.0 % nickel
0 to 0.1 % boron
0 to 0.8 % niobium/tantalum
0 to 3.0 % silicon
0 to 1.0 % manganese
0 to 1.5 % aluminium
0 to 1.8 % titanium
0 to 0.01 % carbon and nitrogen together
balance iron.

By the term "consisting essentially of" as used herein and in the claims hereof is meant that incidental ingredients and impurities may be present in such small amounts which do not affect the stated properties.

Up to 50% by weight of the titanium carbide may preferably be replaced by chromium and/or vanadium carbide.

Because of its above specified contents of chromium and molybdenum the steel matrix of the proposed alloy has a purely ferritic structure. Any residual carbon is converted to carbide by the addition of the element niobium. Titanium is also a good carbide former which with aluminium converts residual contents of undesirable nitrogen into TiN and AlN.

The powder metallurgical method of production and the use of extrapure starting materials in powder form enable very low carbon and nitrogen contents to be achieved so that often the addition of these auxiliary substances niobium, titanium, aluminium may be unnecessary, or only trace amounts are required. Copper, nickel, boron, silicon and manganese may be contained in the steel matrix to the upper above-specified limits for these elements, in order to improve the properites of the alloy.

Surprisingly it was established that carbide-containing steel sinter alloys of the specified composition can be more easily machined than known alloys of this kind based on an austenitic steel matrix, and that they also have a higher resistance to wear and greater hardness than the known alloys. The hardness of known carbide-containing sintered steel alloys which have an austenitic steel matrix is on the average equal to about Rockwell C42, whereas the sintered steel alloy according to the invention may reach Rockwell C52. This could not have been foreseen because austenitic steel alloys lacking a carbide content have hardnesses of about 180 Vickers 10 compared with the 80 to 90 Vickers 10 of purely ferritic steels. It was therefore to be expected that the hardness of carbide-containing sintered steel alloys with a purely ferritic steel matrix would correspondingly also have a lower hardness than the known carbide-containing sinter alloys based on an austenitic steel matrix.

Despite their substantially higher hardness the proposed steel sinter alloy is much easier to machine than known comparable carbide-containing steel sinter alloys having an austenitic steel matrix. Tests have confirmed that when parts made of the proposed steel sinter alloy are machined the cutting tools last three times as long as when machining parts made of the known carbide-containing steel sinter alloys with an austenitic steel matrix.

The corrosion resistance of the proposed steel sinter alloy corresponds to that of the known alloy with an austenitic steel matrix.

In view of its above described useful properties the proposed carbide-containing steel sinter alloy can be used wherever a high corrosion resistance is needed in addition to a high resistance to wear and great hardness. Thus, the steel sinter alloy according to the invention can be used with advantage as a material for the production of abrasion resistant parts which are exposed to attack by corrosive media, for instance in chemical installations and apparatus. Applications of such a kind are parts of pumps, such as pump plungers, shafts, blades, gaskets, pressing tools e.g. such as punches and dies for compacting salts, plastics and loose bulk materials which give rise to wear and corrosion, linings for mills, mixers, extruders and so forth which are exposed to similar stresses and attack.

Four examples of alloys which are within the proposed composition range are set forth in the accompanying table:

| | Alloy (% by weight) | | | |
|---|---|---|---|---|
| | 1 | 2 | 3 | 4 |
| Titanium carbide | 33 | 33 | 34 | 33 |
| Steel matrix containing | 67 | 67 | 66 | 67 |
| chromium | 28.00 | 35.00 | 28.00 | 28.00 |
| Molybdenum | 2.00 | 0.50 | 2.00 | 2.00 |
| Nickel | — | — | 2.00 | 4.00 |
| Copper | 0.50 | — | 0.50 | 0.50 |
| Niobium | 0.50 | 0.50 | — | 0.30 |
| Aluminium | 0.60 | 0.80 | 0.40 | 0.30 |
| Titanium | 0.30 | — | 0.25 | — |
| Boron | 0.01 | 0.02 | 0.02 | 0.02 |
| Iron | Balance | Balance | Balance | Balance |

To produce the steel sinter alloy according to the invention a carbide powder having an average grain size of 5 to 8 microns may be mixed with the several powders of the elements or of compounds thereof, e.g. FeB, NiAl, FeSi, needed for the composition of the steel matrix, the powders being first mixed dry. With the addition of a grinding liquid, such as decahydronapthalene, the powder mixture is then ground down in a ball mill to a mean grain size of about 3 microns and less. The grinding liquid is decanted and the mixture subjected to vacuum drying for the removal of residual liquid. This is followed by a mixing and working process with the addition of pressing aids, such as paraffin or synthetic plastics in solvents. The mixture which is then ready for pressing is moulded into compacts in suitable presses. The compacts are submitted to another vacuum treatment to remove traces of pressing aids and solvents. The compacts are finally sintered in a vacuum which is better than $10^{-2}$ torrs at a temperature of 1300° to 1400°C, according to composition. Sintering is effected in the presence of a liquid phase. Diffusion results in the production an alloy from the several components of the steel matrix and at the same time the density of the body increases.

The density of the steel sinter alloy according to the invention is about 6.4 g/cc.

What is claimed is:

1. A corrosion-resistant and wear-resistant steel sinter alloy consisting essentially of 33% by weight titanium carbide, and 67% by weight of a ferritic steel matrix of the composition:

| | |
|---|---|
| chromium | 28.00% |
| molybdenum | 2.00% |
| copper | 0.50% |
| niobium | 0.50% |
| aluminum | 0.60% |
| titanium | 0.30% |
| boron | 0.01% |
| iron | balance. |

2. A corrosion-resistant and wear-resistant steel sinter alloy consisting essentially of 33% by weight titanium carbide, and 67% by weight of a ferritic steel matrix of the composition:

| | |
|---|---|
| chromium | 35.00% |
| molybdenum | 0.50% |
| nickel | — |
| copper | — |
| niobium | 0.50% |
| aluminum | 0.80% |
| titanium | — |
| boron | 0.02% |
| iron | balance. |

3. A corrosion-resistant and wear-resistant steel sinter alloy consisting essentially of 34% by weight titanium carbide, and 67% by weight of a completely ferritic steel matrix of the composition:

| | |
|---|---|
| chromium | 28.00% |
| molybdenum | 2.00% |
| nickel | 2.00% |
| copper | 0.50% |
| niobium | — |
| aluminum | 0.40% |
| titanium | 0.25% |
| boron | 0.02% |
| iron | balance. |

4. A corrosion-resistant and wear-resistant steel sinter alloy consisting essentially of 33% by weight titanium carbide, and 67% by weight of a completely ferritic steel matrix of the composition:

| | |
|---|---|
| chromium | 28.00% |
| molybdenum | 2.00% |
| nickel | 4.00% |
| copper | 0.50% |
| niobium | 0.30% |
| aluminum | 0.30% |
| boron | 0.02% |
| iron | balance. |

* * * * *